United States Patent [19]

Belliveau et al.

[11] Patent Number: 4,962,687

[45] Date of Patent: Oct. 16, 1990

[54] VARIABLE COLOR LIGHTING SYSTEM

[76] Inventors: Richard S. Belliveau, 2209 W. Braker La., Austin, Tex. 78758; Michael R. Floyd, 1111 W. 40th St., Austin, Tex. 78756; Steven E. Tulk, 12014 Cabana La., Austin, Tex. 78727

[21] Appl. No.: 240,538

[22] Filed: Sep. 6, 1988

[51] Int. Cl.[5] ..... A63J 17/00

[52] U.S. Cl. ..... 84/464 R; 362/85

[58] Field of Search ..... 84/464 R; 362/227, 233, 362/293, 85

[56] References Cited

U.S. PATENT DOCUMENTS

| | | | |
|---|---|---|---|
| 2,553,285 | 5/1951 | Thomas | 88/24 |
| 2,909,097 | 10/1959 | Alden et al. | 88/24 |
| 2,973,683 | 3/1961 | Rowe et al. | 88/1 |
| 3,318,185 | 5/1967 | Kott | 88/24 |
| 3,789,211 | 1/1974 | Kramer | 240/10 R |
| 3,818,216 | 6/1974 | Larraburu | 240/41.3 |
| 4,262,338 | 4/1981 | Gaudio, Jr. | 364/900 |
| 4,378,466 | 3/1983 | Esser | 179/1 SP |
| 4,392,187 | 7/1983 | Bornhorst et al. | 362/233 |
| 4,635,052 | 1/1987 | Aoike et al. | 340/811 |
| 4,662,881 | 11/1986 | Rand | 84/464 R |
| 4,668,895 | 5/1987 | Schneiter | 315/158 |
| 4,753,148 | 6/1988 | Johnson | 84/464 R |

FOREIGN PATENT DOCUMENTS

G86265261 5/1987 Fed. Rep. of Germany .

*Primary Examiner*—Steven L. Stephan
*Assistant Examiner*—Emanuel Todd Voeltz
*Attorney, Agent, or Firm*—Sixbey, Friedman, Leedom & Ferguson

[57] ABSTRACT

The variable color lighting system includes a plurality of lamps controlled by a central controller. The central controller has a number of control channels, and each lamp is preset to be responsive to a specific control channel. To accomplish this, a lamp includes an address circuit which can be varied to respond to a unique address signal from any of the control channels. When the proper address is received, intensity control circuitry within the lamp responds to a digital intensity control signal transmitted by the central controller. The central controller causes all light sources in a lamp to fade from one end intensity value to the next and to reach the next intensity value simultaneously.

26 Claims, 9 Drawing Sheets

Microfiche Appendix Included
(1 Microfiche, 168 Pages)

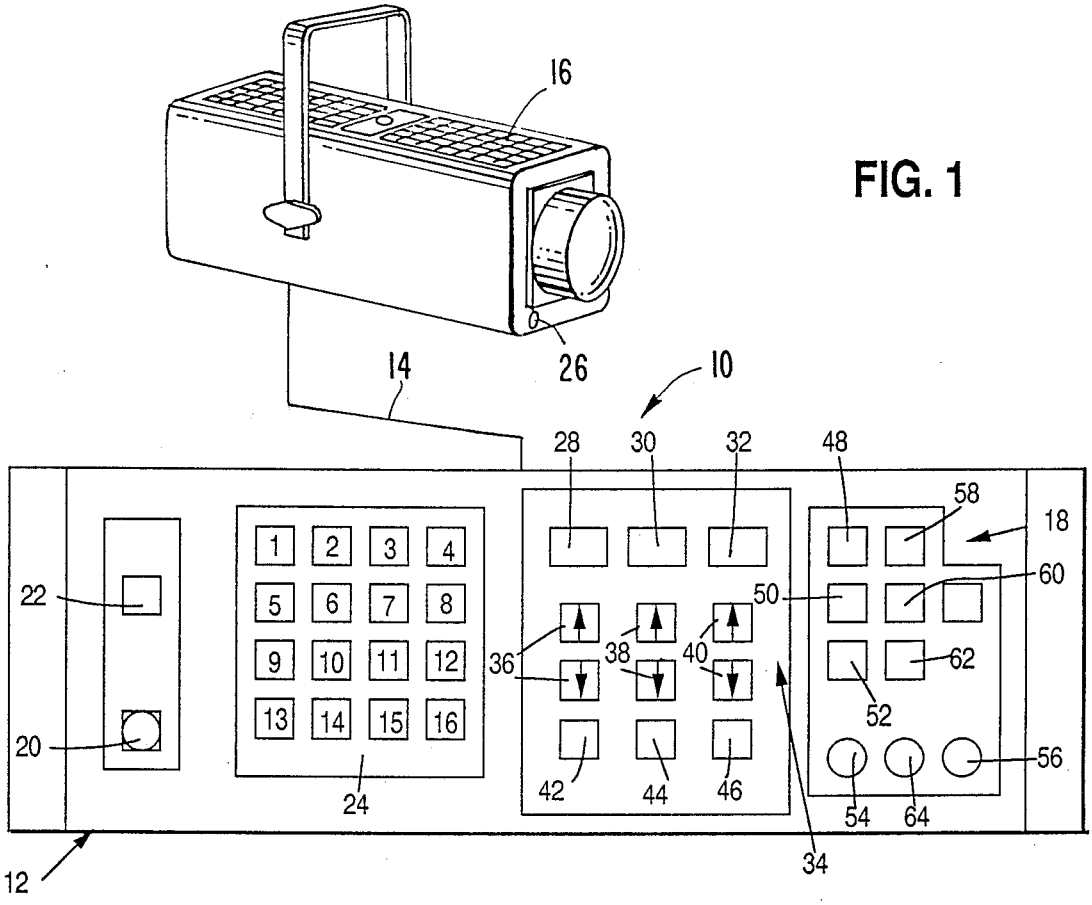
FIG. 1
FIG. 3
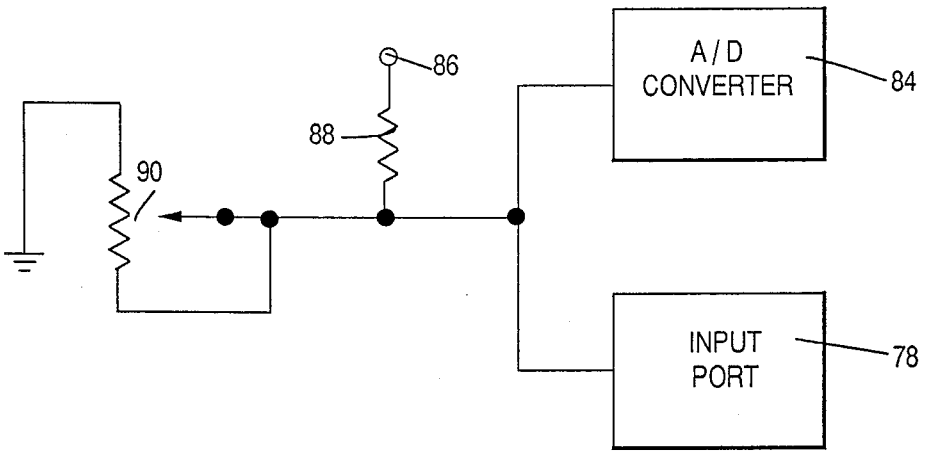

VARIABLE COLOR LIGHTING SYSTEM

The present invention incorporates a microfiche appendix with one microfiche having 168 frames.

TECHNICAL FIELD

The present invention relates generally to optical systems for providing colored lighting effects, and more particularly to a preprogrammable, processor controlled lighting system which provides a smooth color change between successive programmed color displays.

BACKGROUND OF THE INVENTION

Relatively sophisticated optical systems have been developed to produce separate red, green and blue colors which are converged to provide a light beam having any desired color. These known optical systems generally employ a combination of dichroic mirrors or filters combined with a plurality of white light sources to project separate red, green and blue light beams along a desired projection axis. These beams pass through a lens system to provide a mixed output beam of a desired color. Such colored light systems are illustrated by German Utility Model G86 265 26.1 to A. C. R. Braendli & Voegeliag as well as by U.S. Pat. Nos. 2,909,097 to Alden et al, 3,318,185 to Kott and 3,818,216 to Larraburu. In all of these patents, dichroic mirrors or filters are utilized to separate the light spectrum into red, blue and green colors. By varying the intensity of individual light sources, the intensity of individual colors is controlled, and when the colors are recombined and passed along a projection axis, the output color obtained can be varied.

In order to provide an almost infinite variety of lighting effects from lighting systems of the type described, recent systems have been developed which incorporate a central processor to control the individual intensity of each of a plurality of individual light sources. Such a system is illustrated by U.S. Pat. No. 4,622,881 to Rand which illustrates a visual display unit including at least three light sources for providing different colors. A central processor for the unit includes a central stored table where the average power levels for each of the lamps necessary to produce a desired color are stored. The table is accessed with a color number and intensity value, and these can be preprogrammed so that a complete subroutine can be accomplished under the control of the central processor. Also, audio processing circuitry is provided to produce outputs corresponding to amplitude, frequency distribution, envelope and tempo.

Similarly, U.S. Pat. No. 4,635,052 to Aoike et al discloses an image display device using a plurality of light units which provide a black and white rather than a colored light display. However, the intensity of the individual light units for this apparatus is controlled by an intensity control system involving comparators which receive a ramp signal from a sawtooth generator and an image signal from a central control device. The comparator output operates a switch which controls the high frequency voltage supplied to each individual light unit.

The processor controlled color lighting systems which have been previously developed operate effectively to provide a varying color display in response to either input music or a preprogrammed sequence. In both cases, variation in the intensity of individual light sources for red, blue and green light results in the variation in a single color transmitted along a projection axis. However, the aesthetic display provided by such units can be considerably improved by enhancing the light control provided. For example, the provision of digital light control of light sources facilitates the simultaneous use and control of a many individual sources of red, green and blue light with each source being accessed and accurately programmed by an individual control channel. Additionally, if the intensity control circuit for each light source is incorporated in a light fixture remote from the central processor control system, each light source can be rapidly and effectively programmed to respond to a specific control channel, and when desired, the light source can be preprogrammed to a different control channel.

Finally, a programmed display from a variable color lighting system employing a plurality of separately controlled light sources can be considerably enhanced, if, as a light source is programmed from one color intensity to another, it fades into the subsequent color intensity and all light sources reach their programmed intensity at the same time. If this can be accomplished, colors will fade and blend throughout the visible spectrum without the chopping or glitching that is normally associated with most mechanical and electrically controlled color changers.

DISCLOSURE OF THE INVENTION

It is therefore a primary object of the present invention to provide a novel and improved variable color lighting system without moving parts which provides a smooth, rapid selection of color without chopping or flickering between color changes.

Another object of the present invention is to provide a novel and improved variable color lighting system wherein remote light fixtures are controlled by a central controller with each remote fixture containing all the power and dimming control circuits for the fixture. Each fixture contains programmable address circuitry which permits the fixture to be programmed to respond to specific control channels in the central controller.

Yet another object of the present invention is to provide a novel and improved variable color lighting system having a central controller which converts output color intensities to numerical indications which insures easy duplication and repeatability.

A further object of the present invention is to provide a novel and improved variable color lighting system which includes light fixtures controlled from a central processor unit. Each light fixture includes a plurality of chromatic light sources, and the intensity of each chromatic light source is controlled in accordance with a program from the central processor. As the intensities of the light sources are changed to change from a first color output to a second color output, each light source fades between a first intensity and a second programmed intensity, and all light sources reach the second programmed intensity simultaneously.

Yet a further object of the present invention is to provide a novel and improved variable color lighting system wherein a plurality of light fixtures, each containing three light sources, are controlled by a central controller. The central controller includes a plurality of control channels, and one or more light fixtures are assigned to each control channel. Intensity information is programmed for each light fixture in a channel which is to be activated during a specific program period.

A still further object of the present invention is to provide a novel and improved variable color lighting system wherein a plurality of light fixtures containing a plurality of light sources are controlled by a central controller which includes a plurality of control channels. One or more light fixtures are assigned to each control channel, and normally, intensity values for each light source within a light fixture assigned to a specific control channel are programmed for periods when the control channel is programmed to be active. However, intensity control can be made responsive to an audio input, so that when the control channel is activated in response to a program, the intensity of the light sources controlled by that channel will be responsive to the input audio rather than preprogrammed intensity value.

BRIEF DESCRIPTION OF THE DRAWINGS

FIG. 1 is a diagram showing the variable color lighting system of the present invention;

FIG. 3 is a circuit diagram of the auto and cross-fade rate controllers for the variable color lighting system of FIG. 1;

DESCRIPTION OF THE PREFERRED EMBODIMENTS

Figure 2:
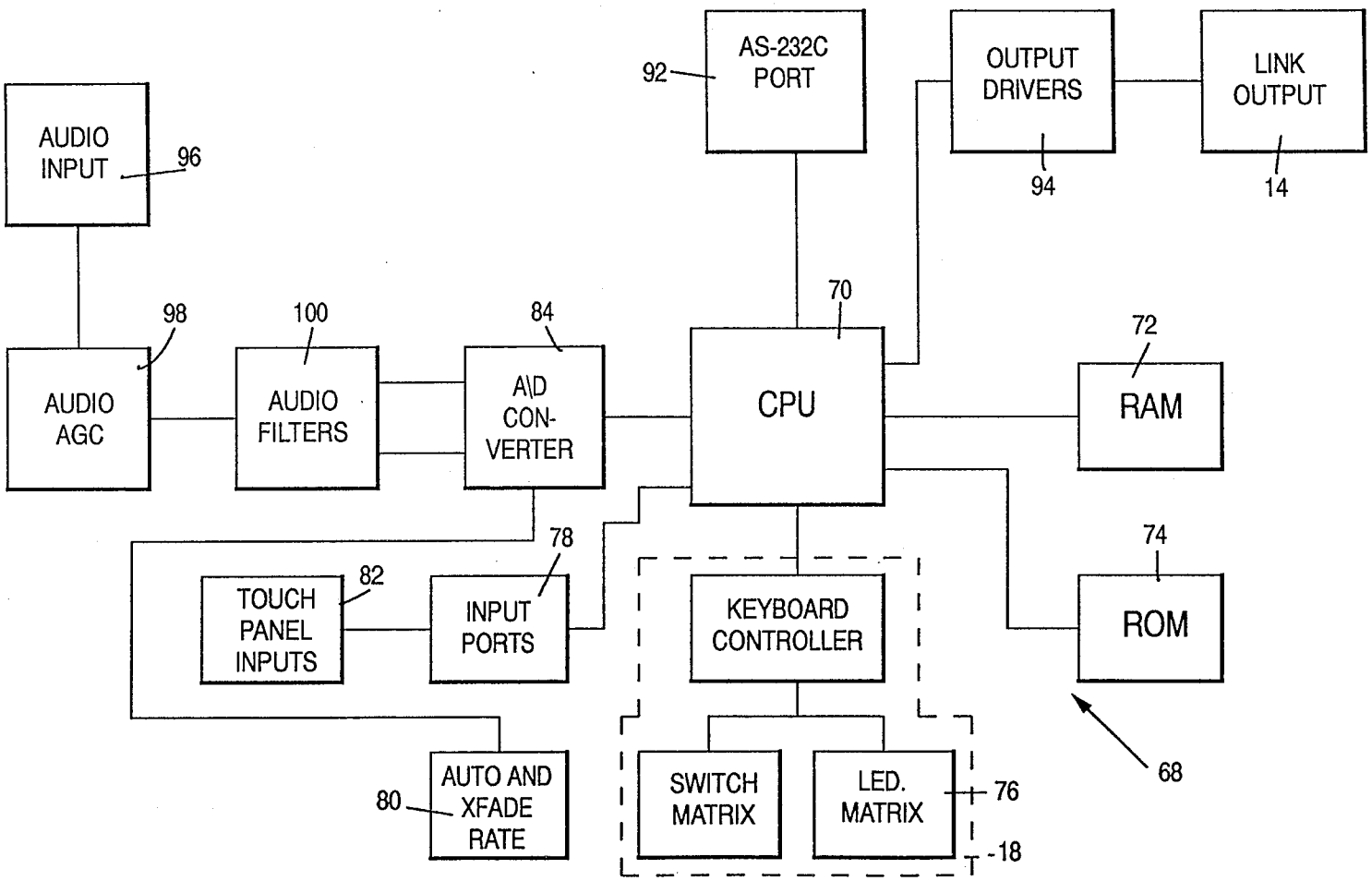
FIG. 2 is a block diagram of the control system for the central controller of the variable color lighting system of FIG. 1.

Referring now to FIG. 1 the variable color lighting system of the present invention indicated generally at 10 includes a central controller 12 which operates by means of connecting data links 14 to control a plurality of light fixtures 16, one of which is illustrated in FIG. 1. In use, however, the central controller may be linked to control as many as 128 light fixtures 16.

The central controller 12 includes a control panel 18 which provides control buttons for a switching matrix, control knobs and condition indicator displays. The control panel includes a power control switch 20 which is activated to provide power to the unit. Situated above the power control switch is a stand-by switch 22 which selectively activates or disables the output of the central controller over the data links 14 to the various light fixtures 16, regardless of the operational status of the central controller. Each light fixture includes three light sources which individually provide a red, green or blue light, as well as dichroic mirrors and lens arrays to provide a combined, colored beam along a projection axis.

The selection of individual lamp fixtures 16 is controlled by 16 channel address switches 24, and each light fixture is assigned to a specific channel. This fixture assignment is programmed by an external digital address switch 26 which is provided on each light fixture 16. The digital address switch may be moved to 16 positions to select one of the 16 channels controlled by the channel switches 24. The light fixture may be easily brought under the control of another channel merely by repositioning the digital address switch 26.

Three visual indicators 28, 30 and 32 are provided on the control panel 18. These three indicators combine to display intensity information, memory information, and memory page information. The intensity indication provided by the indicators 28, 30 and 32 may be varied by six intensity control switches indicated generally at 34. There are two intensity control switches 36 for red light control, two intensity control switches 38 for green light control, and two intensity control switches 40 for blue light control. Depression of the top switch in each switch pair increases the intensity of the light controlled thereby, while depression of the bottom switch in the switch pair decreases light intensity as indicated by the arrows provided on the respective switches. Thus, assuming that the light fixture 16 is assigned to channel 1, the channel 1 switch of the channel switches 24 would be depressed, and immediately, a number indicative of the individual preset intensity for each of three light sources within the fixture 16 would be displayed on the indicators 28, 30 and 32. Thus, a number indicative of the intensity of the red light source would appear on the indicator 28, a number indicative of the intensity of the green light source would appear on the indicator 30, and a number indicative of the intensity of the blue light source would appear on the indicator 32. To vary the intensity setting of these individual light sources, the red, green and blue light control buttons 36, 38 and 40 can then be activated in accordance with a procedure to be subsequently described to either increase or decrease the programmed intensity of the respective light sources. If the intensity of a specific light source is increased, the numbers displayed by the respective indicator 28, 30 or 32 associated therewith would also increase, while conversely, a decrease in intensity causes a corresponding decrease in the displayed numbers. Thus, each intensity level is indicated by a specific numeric value.

With a channel switch 24 depressed, the indicators 28, 30 and 32 display intensity numbers for the red, green and blue light sources within the fixtures 16 for that channel, and this may be designated as an RGB mode of display. However, when a channel switch 24 is not depressed, the indicator 28 will provide a master intensity display code, the indicator 30 will provide a memory display code, and the indicator 32 will provide a memory page display. This display can be designated as the IMP mode, wherein the intensity display number appearing on the indicator 28 is indicative of the output level provided by all light fixtures 16 assigned to one of the channels 1–16.

Also in the IMP mode, the indicator 30 will indicate a memory number while the indicator 32 will indicate a page number. A memory constitutes a group of pages with many pages making up one memory. A page constitutes a scene which is visualized with the RGB mode display; each page containing stored information concerning the intensities of the lamps in the light fixtures for specific programmed channels. Thus, while the indicator 30 provides the number of one of a plurality of memories, the indicator 32 provides an indication of a page number. It should also be noted that in the IMP display mode, the red light control switches 36 control the master intensity, the green light control switches 38 select a memory, and the blue light control switches 40 select a page.

The control panel 18 also includes a select switch 42 which is used to initialize the recording, erasure or the editing of a page.

Next to the select switch, a record switch 44 is provided which, when depressed, finalizes a record or edit process and turns off the select switch. Also, an erase switch 46 is provided which, when depressed in conjunction with the select and record switch, operates to erase an entire page.

To control the page advance function, a random switch 48, an audio switch 50, an auto switch 52 and a rate control knob 54 are provided. The random switch may be activated with either the auto or audio switch to cause the pages to advance in random sequence. Also, the random switch may be activated in combination with manual operation of the blue light control switches 40 to manually advance pages in random sequence.

The audio switch causes pages to advance to an audio bass level, and depression of the audio switch will turn off the auto switch if it was previously selected. The audio advance may be fine tuned by turning an audio knob 56 which constitutes a rotatable tuning knob.

The page advance function also responds to page change requests from "remote page select" back panel inputs (not shown). The resultant page number is a function of all 12 input channels.

If the control system is in a "slave" mode, its page advance depends on control packets received from a "master" system at a RS-232 port in a manner to be subsequently described.

Finally, the auto switch may be activated to automatically advance through the pages of memory which have been prerecorded. The advance speed may be adjusted for automatic advance by rotating the rate control knob 54.

A control section on the control panel 18 includes a program control switch 58, a modulate control switch 60, and a cycle control switch 62. Depression of the program control switch allows the various light fixtures 16 to operate under the preprogrammed control of the pages of a memory. In the operation of the variable color lighting system 10, one of the switches 58, 60 or 62 in the control section must be activated.

If the modulate switch is depressed, the intensity control for the lamps preprogrammed on a page changes from programmed intensities to audio filter control of bass and treble. Modulate control samples an audio input that is filtered into two different frequencies, and the channels which have been programmed on the page for operation are no longer controlled in direct response to the red, green and blue intensity settings in memory. Instead, the red, green and blue intensities of the previously programmed channels in the current page are modulated by a built-in random generator. For example, red might be assigned to the bass filter, and blue to the treble filter. Then if the music input to the device contains high bass levels, high intensity red levels will occur in the preprogrammed channels. After a random period of time, modulate control will re-assign any two chromatic intensities to any two audio filter levels.

Finally, the cycle control switch 62 operates to cycle the preprogrammed channels on a page through the color spectrum. Cycle operation allows the colors to fade through the spectrum with the rate being adjusted by a fade rate control knob 64. Also, a cross-fade switch 66 is provided which manually provides a smooth fade from old color brightness values to new ones. Again, the rate of fade can be controlled by the fade rate control knob 64.

When an operator first activates the variable color lighting system 10 by turning on the power switch 20, the device will initially be in the IMP display mode after memory test and the stand-by switch 22 will be on. Thus, the light fixtures 16 will not yet be energized.

Since the central controller was preprogrammed, an operator activating the unit for the first time may wish to know what intensities were programmed into each of the program channels. Consequently, the operator would depress the channel 1 button to activate the associated channel switch and switch the display from the IMP display to the RGB display. Now, the numerical values of the red, green and blue intensities programmed into channel 1 will appear on the indicators 28, 30 and 32. The operator would then progress through the remaining program channels by pressing the channel button, and in each case, by holding the button, the display will immediately change from the IMP to the RGB display. Releasing that button instantly returns the display to IMP.

If the operator now wishes to alter a programmed page after reviewing the page, he depresses the select switch 42 with the display in the IMP mode. He then depresses the channel switch for the channel which he wishes to alter, which brings up the RGB display. Assume that the RGB display is 4,9,0, and the operator wishes to preprogram the display to 0,9,0, he will then push the "down" button for the red light control 36 to reduce the 4 to 0. When the adjustment is complete, he will then depress the record switch 44 and the new intensity will be recorded for the channel involved.

If an operator desires to erase an entire page, he will hit the select switch 42, the erase switch 46, and then the record switch 44, and this will record a blank page.

To increase the number of light fixtures 16 which may be controlled by a single control panel 18 for a central controller 12, each central controller may be interconnected as a "slave" with another central controller. To put a controller in the "slave" mode, the select switch 42 is depressed and held for a predetermined period, after which the indicator 28 will provide a "SL" indication. In the "slave" mode, the slave controller's intensity, memory, page, stand-by, cycle, modulate, program, cross-fade, audio, advance rate and random functions are controlled by the master controller. The indicator on the "slave" controller will mirror image the IMP display on the master controller, and all functions that change a page on the master will result in duplication of that page on the slave. To return the slave controller to a master controller operation, the select switch is again depressed and held for a predetermined time.

Referring now to FIG. 2, the central processor control system 68 for the central controller 12 is illustrated. Broadly, this control system includes a central processor 70 with RAM and ROM memory units 72 and 74, respectively. The central processor receives inputs from the various keyboard buttons and switch matrices previously described with respect to the control panel 18 and controls the displays and the operation of an LED matrix 76 which lights the respective buttons on the control panel which are either activated or under program control.

Further, the central processor includes input ports 78 which provide inputs from ancillary touch panel inputs 82. The auto and cross-fade control from timers 80 is also provided to an analog-to-digital converter 84, and as indicated in FIG. 3, each auto and cross-fade rate controller is quite simple. One such controller, as shown in FIG. 3, receives power from a suitable power supply connection 86 over a power supply resistor 88, and the signal level provided to the analog-to-digital converter and input port for the central processor is controlled by a grounded potentiometer 90. The potentiometers 90 for the separate auto rate and cross-fade rate timers are operated by the rate control knob 54 for the auto rate controller and by the fade rate control knob 64 for the cross-fade rate controller.

Normally, the central processor 70 operates in response to program med intensity information temporarily entered into the RAM 72. Nine memories each containing 99 pages are retained, and each page includes information for the 16 output channels with channel color intensity and dimming information. A standard RS 232 port 92 is provided on the central processor to permit memories to be saved and exchanged with most standard personal computers.

The central processing unit 70 converts the programmed intensity information from the RAM 72 into a data stream of long and short pulses with a short pulse being read as a zero (0) and a long pulse as a one (1). This data information with an address and a strobe signal is provided by output drivers 94 to the respective data links 14.

When the modulate switch is depressed, the system responds to music from an audio input 96 which is provided to an audio automatic gain control circuit 98 and then to audio filters 100. The automatic gain control circuit limits the output signal therefrom to a given voltage, while preserving dynamic range. The output audio signal is then divided into frequency ranges and filtered to provide rising and falling DC output signals from the audio filters 100 which change with dynamics. As previously indicated the audio filters 100 provide bass and treble output DC signals to the analog-to-digital converter 84, and the converter converts these signals and provides them as intensity control signals to the central processor unit 70. The converter 84 is an eight input multiplex analog-to-digital converter of the type manufactured by National Semiconductor, Inc. and designated as ADC808, but equivalent converters can be used.

Figure 4:
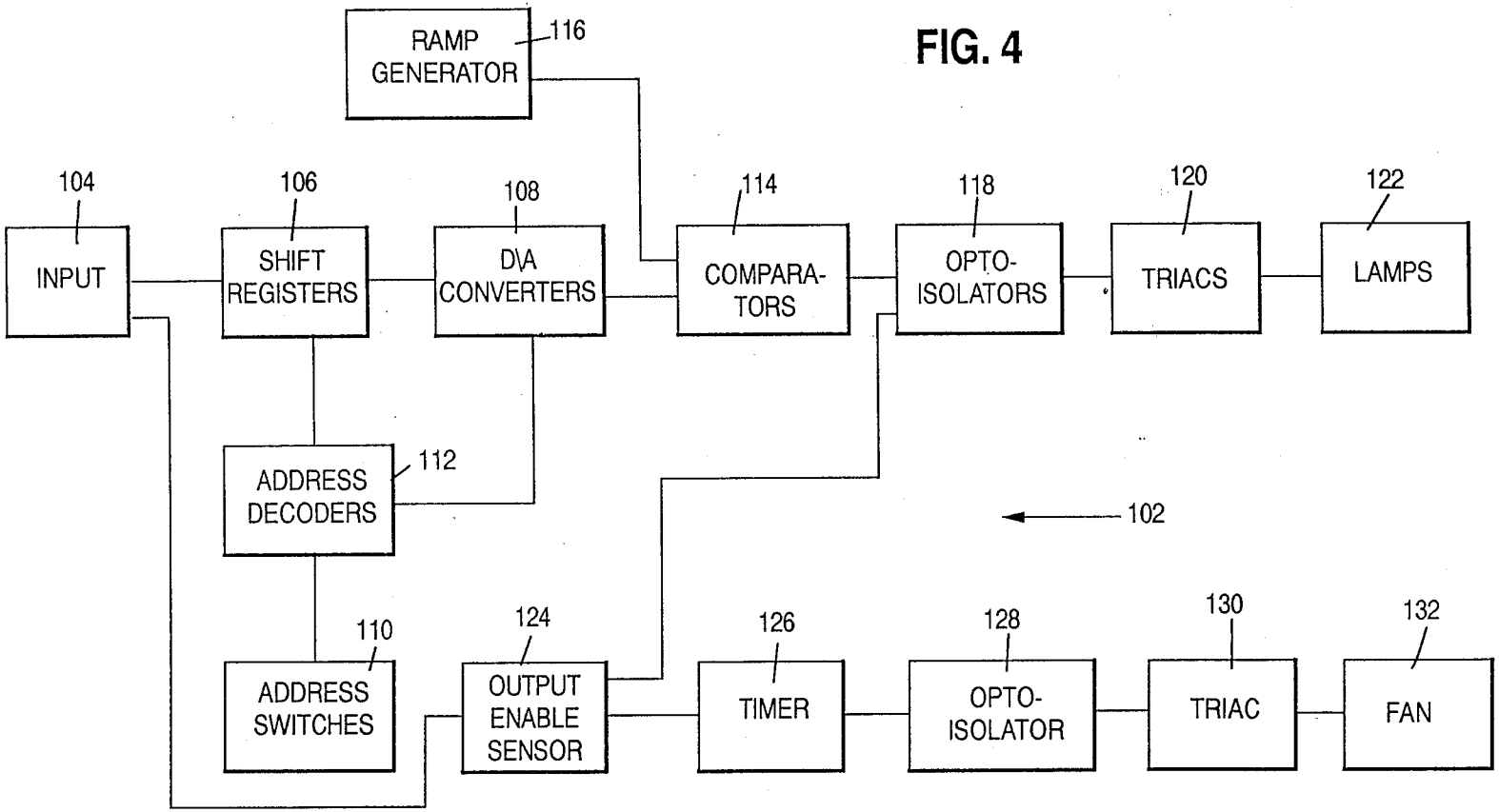
FIG. 4 is a block diagram of the fixture control circuit for the light fixture of FIG. 1.

Referring now to FIG. 4, a fixture control circuit 102 for one of the light fixtures 16 is illustrated. This fixture control circuit is located within the housing for the light fixture 16, and consequently is remote from the central controller 12. The digital input packet from the central processor unit provided over the data link 14 is received at an input 104. This signal is shifted through shift registers 106, and the digital output from the shift registers is converted to an analog output by a digital-to-analog converter 108. The shift registers are always operative, but the digital-to-analog converter 108 operates only if the incoming data packet at the input 104 contains the same channel address as that set by the address switch 26 for the respective light fixture 16. As previously indicated, this light fixture is assigned to a definite channel by a digital address switch 26 on the fixture.

The channel address provided by the data link 14 is processed in a manner to be described and provided to address decoders 112, and the digital-to-analog converter 108 operates when the address from the address decoders 112 matches that contained in the data packet on the input 104. The digital-to-analog converter 108 provides three analog outputs indicative of the intensity value preset for each of the three light sources within a light fixture 16. These three analog outputs are compared in three comparators 114 with a ramp signal generated by a ramp generator 116. When the ramp generator input to any of the comparators reaches the level of the analog signal provided to each comparator, that comparator changes state and provides an output signal to one of three optoisolators 118. Each of these optoisolators may be formed by a light emitting diode which transmits a light signal in response to a respective comparator output which is received by a light responsive element in the control circuit for a power switch. For example, this signal, across the optoisolator may control the operation of one of three triac switches 120 which provides power to illuminate one of three lamps 122. The signal from the optoisolator is provided to the gate circuit of a triac and determines the time period during which the triac will conduct to provide power to a lamp. Thus, the intensity of the lamp is limited to a value controlled by the lamp power supply through the associated triac.

An output enable sensor 124 is triggered into operation by the arrival of a strobe signal and the data packet at the input 104, and operates to provide a control signal by means of a timer 126 and optoisolator 128 to a triac 130 connected to a power supply. When the triac is activated, it permits power from the power supply to flow to a cooling fan 132 within the fixture 16. However, if the output enable sensor 124 senses that the input 104 has ceased providing intensity control signals, it operates to trigger the timer 126 which causes a delay period to be initiated, after which a control signal is removed from the triac 138. Thus, the fan is not deactivated until the expiration of a delay for a period of time after the lamps 132 are deactivated so that the fan continues to cool the light fixture 16. After the time set by the timer expires, the fan 132 is deactivated.

Figure 5:
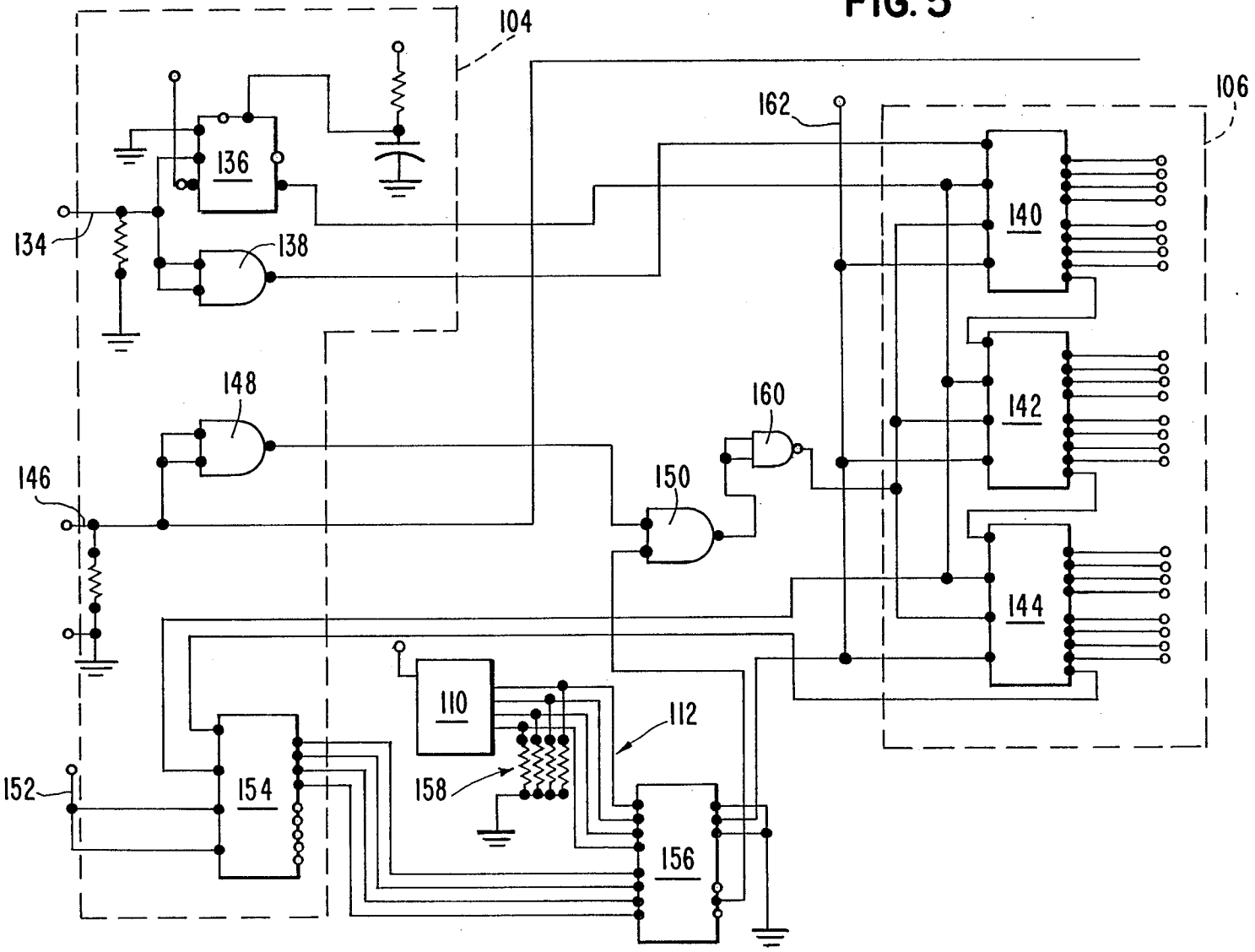
FIG. 5 is a circuit diagram of the input, shift register and address circuits of FIG. 4.

FIG. 5 discloses in greater detail the input section 104, shift registers 106, address switches 110 and address decoders 112 of FIG. 4. The data packet from the data link 14 is received on a data input 134, and the first portion of an input bit triggers a one shot multivibrator 136 which clocks the shift registers 106. The data packet is gated through a gate 138 and is provided to the first of three shift registers 140, 142 and 144. These constitute two part shift registers such as those manufactured by Motorola and designated MC14094, or equivalent shift register units.

The strobe signal from the data packet is provided to an input 146 to cause an output from a gate 148 to one input of an AND gate 150. Similarly, the address input from the data packet is provided by an input 152 to a one part address shift register 154 which may be a Motorola shift register designated as MC14094. The output from the address shift register is provided to a comparator 156, which is a magnitude comparator of the type manufactured by RCA and designated CD4063. The magnitude comparator receives address inputs not only from the address shift register 154, but also receives the preset address input from the address switches 110. Power through these switches, in combination with resistors 158, provides a preset channel address to the magnitude comparator 156, and these components form the address decoders 112. If the two addresses received by the magnitude comparator 156 correspond, an output is provided from the magnitude comparator to the remaining input of the AND gate 150 causing the output of the AND gate 150 to trigger a gate 160 and enable parallel output latches for the shift registers 106. The enable signal is also provided to the digital-to-analog converter 108 on a terminal 162.

Figure 6:
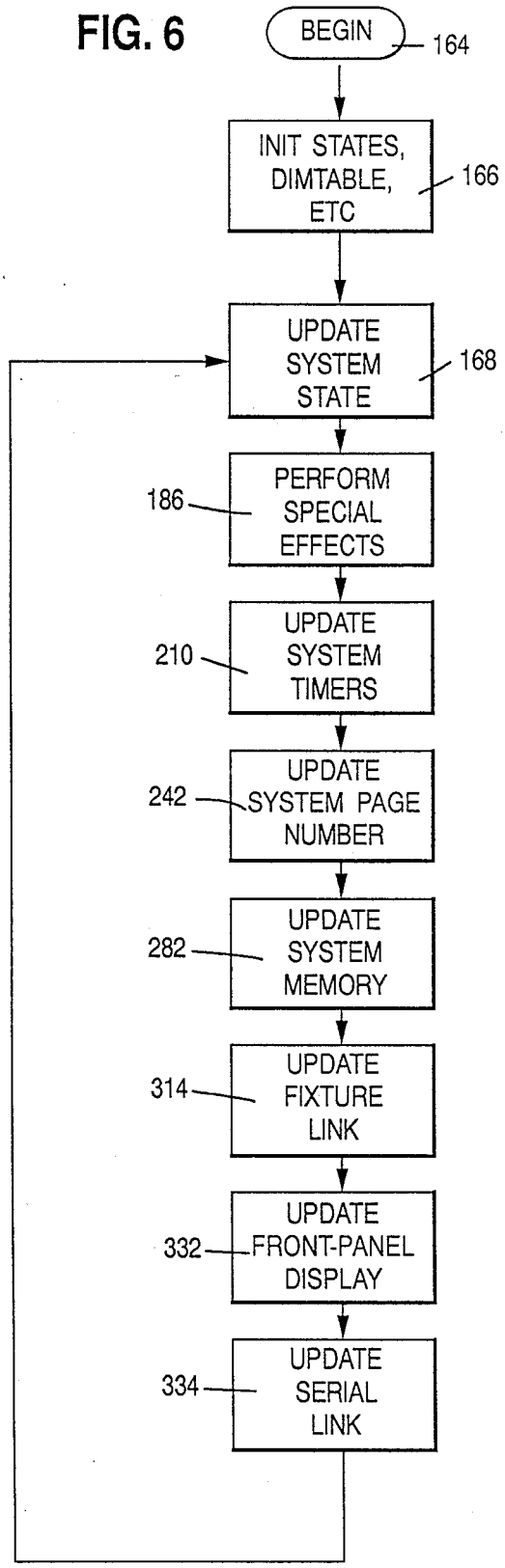
FIG. 6 is a flow diagram of the control loop provided by the central processing unit for the central controller of FIG. 1.

The overall operation of the central processor unit 70 will best be understood by reference to the flow diagrams of FIGS. 6–14 taken in combination with the program of the appendix. FIG. 6 illustrates the main operational control loop for the central processor unit, which, when began at 164 first goes into an initiate state at 166. In the initiate state, the various components of the variable color lighting system 10 are automatically brought to an operating mode, and for example, the front panel numeric display is activated, the various memories for fixture intensity and dimming control are activated, all other memories are activated, the various central processor input ports are activated, all special effects areas, such as the modulate function, are activated, and the front panel displays 28, 30 and 32 are up-dated. Once this is accomplished, the central processor unit begins the actual system control loop by up-dating the system state at 168.

Figure 7:
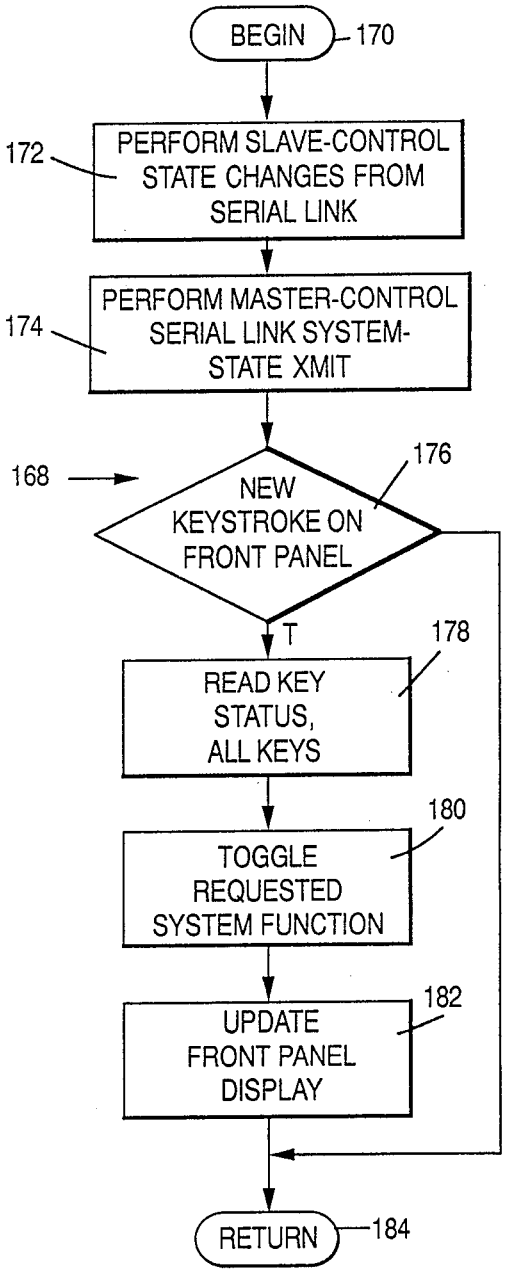
FIG. 7 is a flow diagram for the system up-date step of the flow diagram of FIG. 6.

With reference to FIG. 7, the up-date of the system state is begun at 170 where the memory 72 is checked at 172 to determine if the central controller 12 has been put in the "slave" mode and if any data has been received and stored in the slave mode. Next, at 174, the system checks to determine if the central controller is in the "master" control mode and if any special effects commands or other data commands have been provided in this mode. If new information is not present from either the activation of control keys in either the "slave" or "master" mode, then at 176 the system update is terminated. On the other hand, if new information is sensed, then the status of all keys are read at 178 and the newly requested system function is toggled at 180. Subsequently, at 182 the display on the control panel 18 is up-dated and at 184, the system is now ready for the next programmed function.

Figure 8:
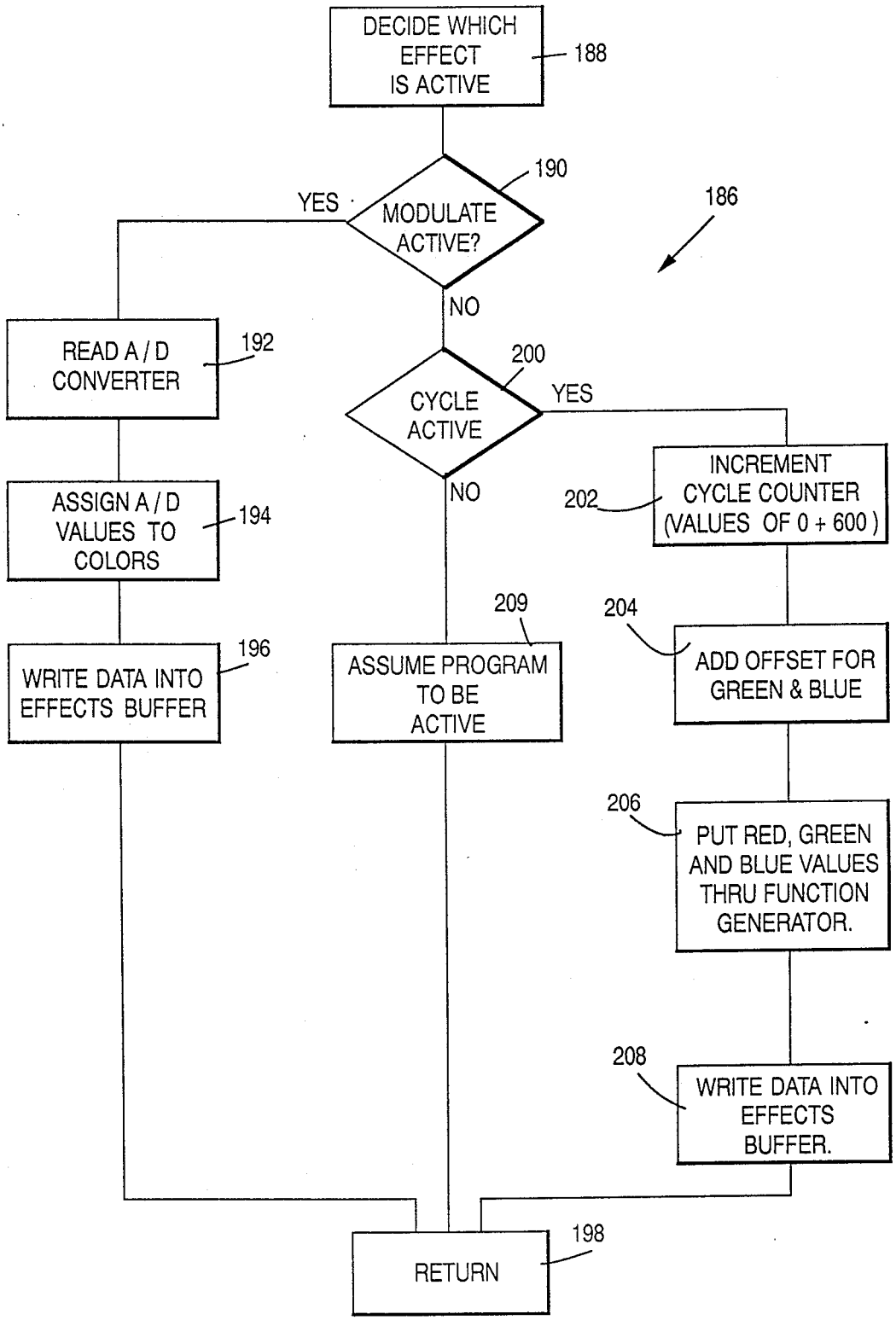
FIG. 8 is a flow diagram for the perform special effects step of the flow diagram of FIG. 6.

As indicated in FIGS. 6 and 8, the next programmed function at 186 is the performance of any special effects, such as the modulate function or the cycle function, which have been keyed into the control panel 18. It is first decided at 188 if any special effect key is active and at 190. If the modulate switch 60 is activated, the system will operate at 192 to read the output of the analog-to-digital converter 84 and then, at 164, to assign color intensity values in accordance with the output of the analog-to-digital converter. As previously described, the central processing unit uses the programmed channels which have been previously programmed for each page, and assigns new color intensity values to each channel in accordance with the output of the audio filters 100. This newly assigned intensity data is now written into the memory 72 at 196, and the system is returned at 198 for the next processing step.

If the modulate function is not sensed, the system checks to see if the cycle switch 52 has been activated, and if this switch is active, then at 200 a cycle function is begun. As previously indicated, cycle operation allows the colors to fade through the spectrum, with the rate being adjusted by a rate control knob 64. To accomplish this, a cycle control counter is incremented at 202, and the speed that this cycle control counter is incremented is determined by the positioning of the rate control knob. Incrementing this cycle counter adds increments to the various color intensity values previously stored at 204, and as these values are incremented, the colors change. The various color values are put through a function generator 206, the resultant data is written into the memory 72, and then the system is returned for the next step in the program.

If neither the modulate or cycle switches have been activated, it is then assumed at 209 that the previously programmed data is to control the operation of the unit, and the system is ready to perform the next step in the program.

With the special effects check completed, the system next up-dates all system timers at 210. Basically, the system includes an LED timer for the control panel LED matrix, an audio timer, a cross-fade timer, and an advance timer. Each time the system accomplishes the program loop shown in FIG. 6, the front panel LED timer is incremented, the advance timer is incremented, and the cross-fade cycle counter is incremented. To accomplish automatic cross-fade of colors from one page of the program to the next wherein all three colors arrive at a new value simultaneously, the central processing unit is programmed to arrive at each new color intensity within a specific number of steps. However, the step-time period for each step is varied so that all three colors reach a new value at the same time. This is accomplished in accordance with the following formulas:

$$\text{Step Period} = \frac{\text{Maximum Intensity}}{ABS\,(\text{old intensity} - \text{new intensity})}$$

Where step period is expressed a s number of control loops, maximum intensity is the maximum programmable brightness, ABS( ) computes absolute value, old intensity is current broadcast intensity, and new intensity is an intensity value retrieved from memory.

If the crossfade knob timer times out, and if intensities differ, and if:

$$\left(\frac{\text{crossfade counter}}{\text{step period}}\right)$$

has no remainder, then apply a step of +1 or −1 to the current broadcast intensity so that the difference:

(old intensity-new intensity)

approaches zero.

Thus, each time the program changes page, the central processing unit computes a new step frequency for each color, and each time the cross-fade cycle counter is incremented as the program processes through the control loop, a new increment value is added to each color intensity so that the three new desired intensities are reached simultaneously.

Figure 9:
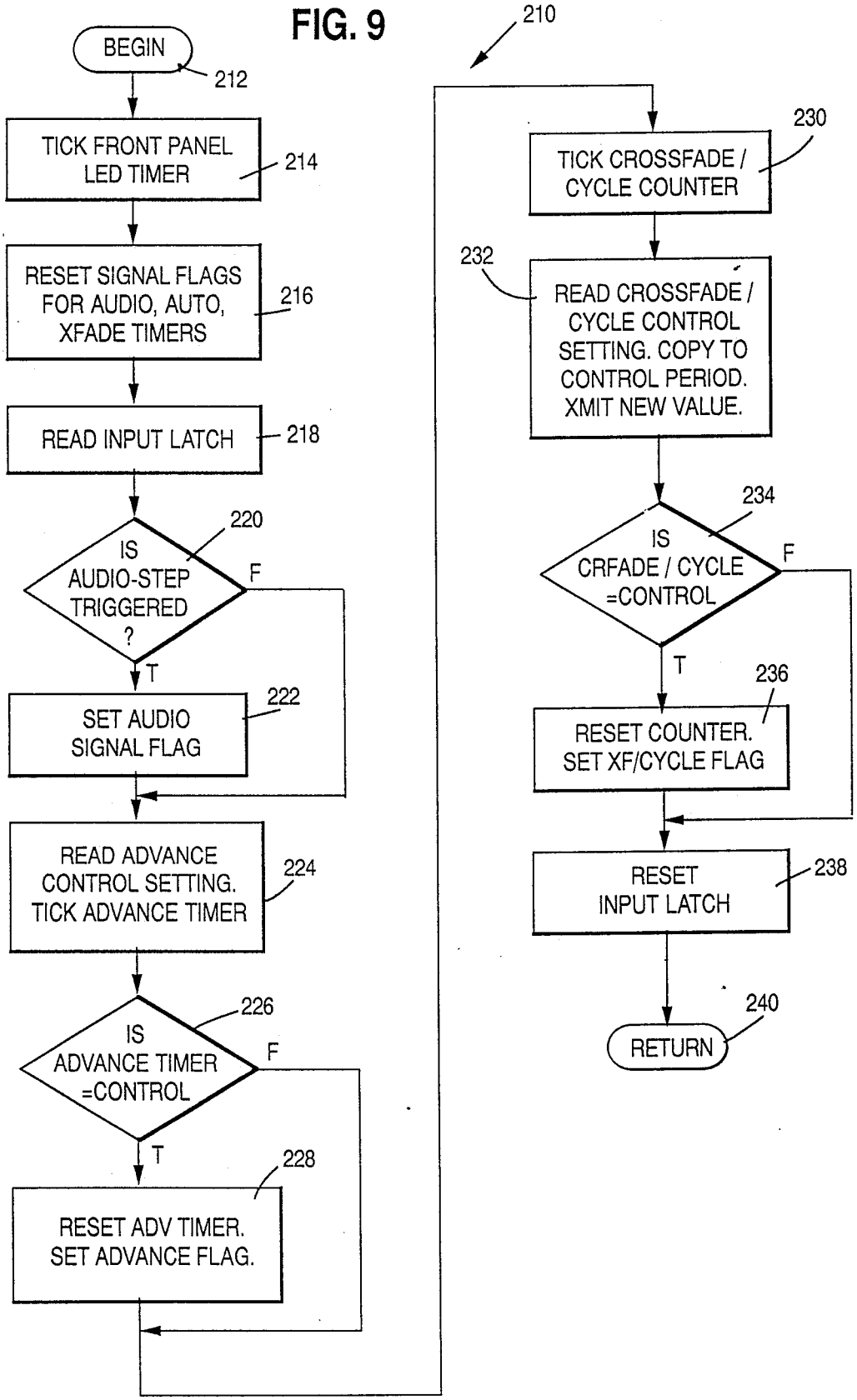
FIG. 9 is a flow diagram of the timer up-date step of the flow diagram of FIG. 6.

In FIG. 9, the timer up-date is begun at 212 and the front panel LED timer is incremented at 214. Then, at 216, the flags for the audio, auto, and cross-fade timers are reset, and the input latch is read at 218. At 220, it is determined whether or not the audio step is triggered and if it is, the audio signal flag is set at 222. Then, at 224, the advance control setting is read, and the advance timer is incremented. At 226, it is determined whether or not the advance timer as incremented is equal to the advance timer control, and if it is, the advance timer is reset and the advance flag is set at 228. At 230, the cross-fade cycle counter is incremented, and then at 232, the cross-fade cycle control setting is read. This is compared with the processor generated increment control value, and the new value is transmitted, and at 234 it is determined whether the cross-fade counter is equal to the control value. If it is, the cross-fade counter is reset and the cross-fade cycle flag is set at 236. Then the input latch is reset at 238 and the system is returned for the next step at 240.

Figure 10:
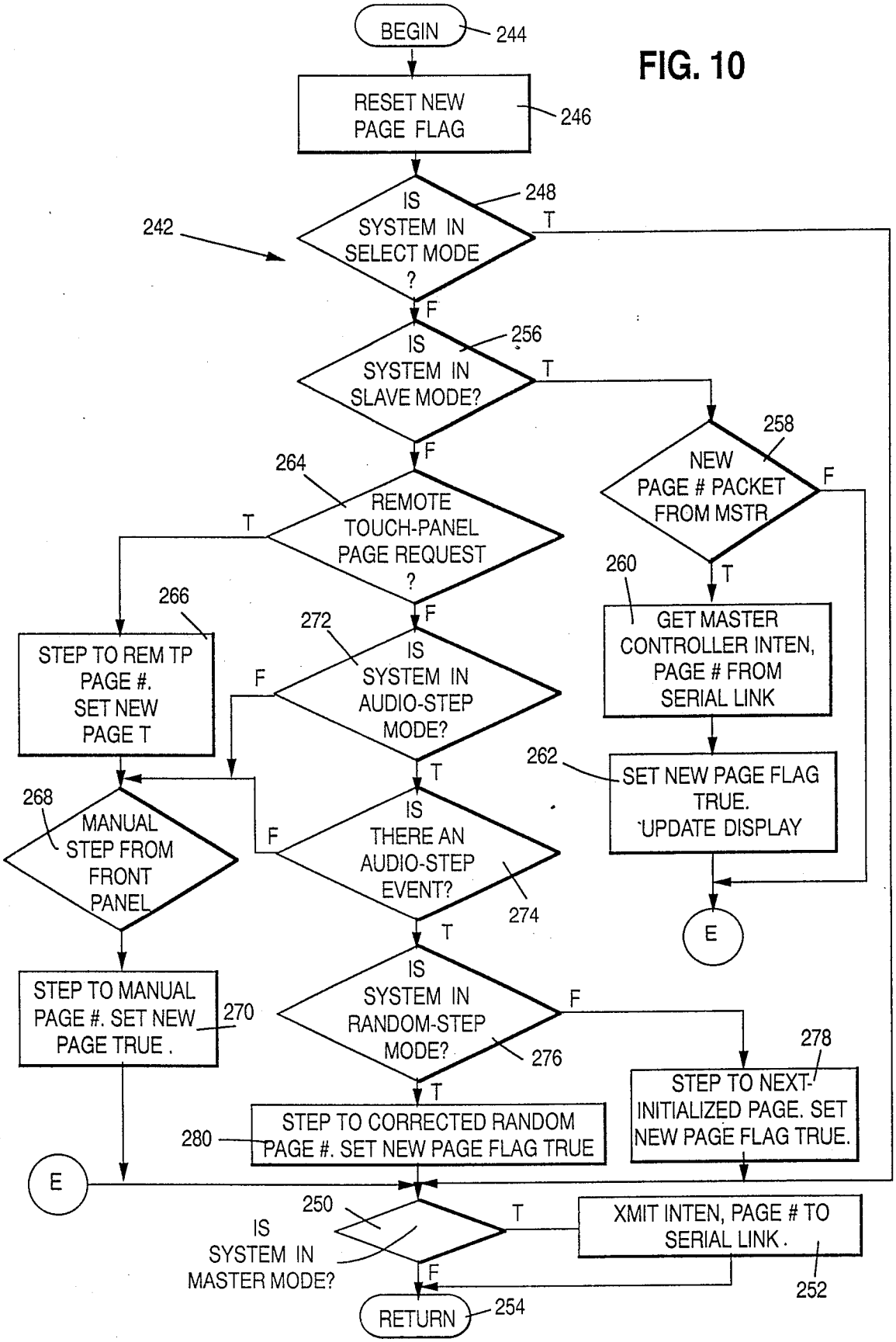
FIG. 10 is a flow diagram of the system page number up-date step for the flow diagram of FIG. 6.

After the system timers are up-dated, the system page number is up-dated at 242. As illustrated in FIG. 10, the system page up-date begins at 244 and a new page flag is reset at 246. At 248, a check is made to determine whether or not the system is in the "select" mode with the select switch 42 activated, and if it is, a check is then made at 250 to determine if the system is in the "master" mode. If the system is in the "master" mode, then at 252 the intensity information and page number are transmitted via the RS232 port 92 and the system is returned at 254 for the next program step. If the system is not in the "master" mode, then the system is directly returned at 254 for the next program step.

If the check at 248 shows that the system is not in the "select" mode, then a check is made at 256 to determine if the system is in the "slave" mode. If this check shows that slave mode operation has been initiated, then a check is made at 258 to determine if a new page number and data packet has been received from the master. If it has not, then the program moves to the system master mode check at 250.

On the other hand, if new page and data packet information have been received from the master, then the master controller intensity and page number one obtained at 260, the display on the master controller is up-dated at 262, and a new page flag is set. Then the system progresses to the master mode check at 250.

If the slave mode check at 256 shows that the system is not in the slave mode, then at 264 the system checks to determine if a page request has been received from a remote touch panel connected to one of the input ports 78. If a touch panel request is noted, then at 266 the system will broadcast the touch panel page number from memory and set a new page flag true. Subsequently, the system will proceed to 268 to determine if there is a manual page number set from the control panel 18, and at 270 will step to the manually set page number and set a new page true flag. Then, the system will return to the master mode check at 250.

If the remote touch panel request check at 264 shows that there is no touch panel page request, then a check is made at 272 to determine if the system is in the audio step mode. If the system is not, then it proceeds with the steps 268, 270 and 250. On the other hand, if the system is in the audio step mode, then at 274 a determination is made as to whether the audio step timer has timed out. If it has not, the system again returns to steps 268, 270 and 250, but if it has, then a determination is made at 276 as to whether or not the system is in the random mode. If the system is not in the random mode, the program steps to the next preprogrammed initialized page and sets a new page flag true at 278. It then proceeds with the system master mode check at 250.

On the other hand, if the system is in the random step mode, it then steps to a corrected random page number at 280, sets the new page flag to "true", and moves on to the master mode check at 250.

Figure 11:
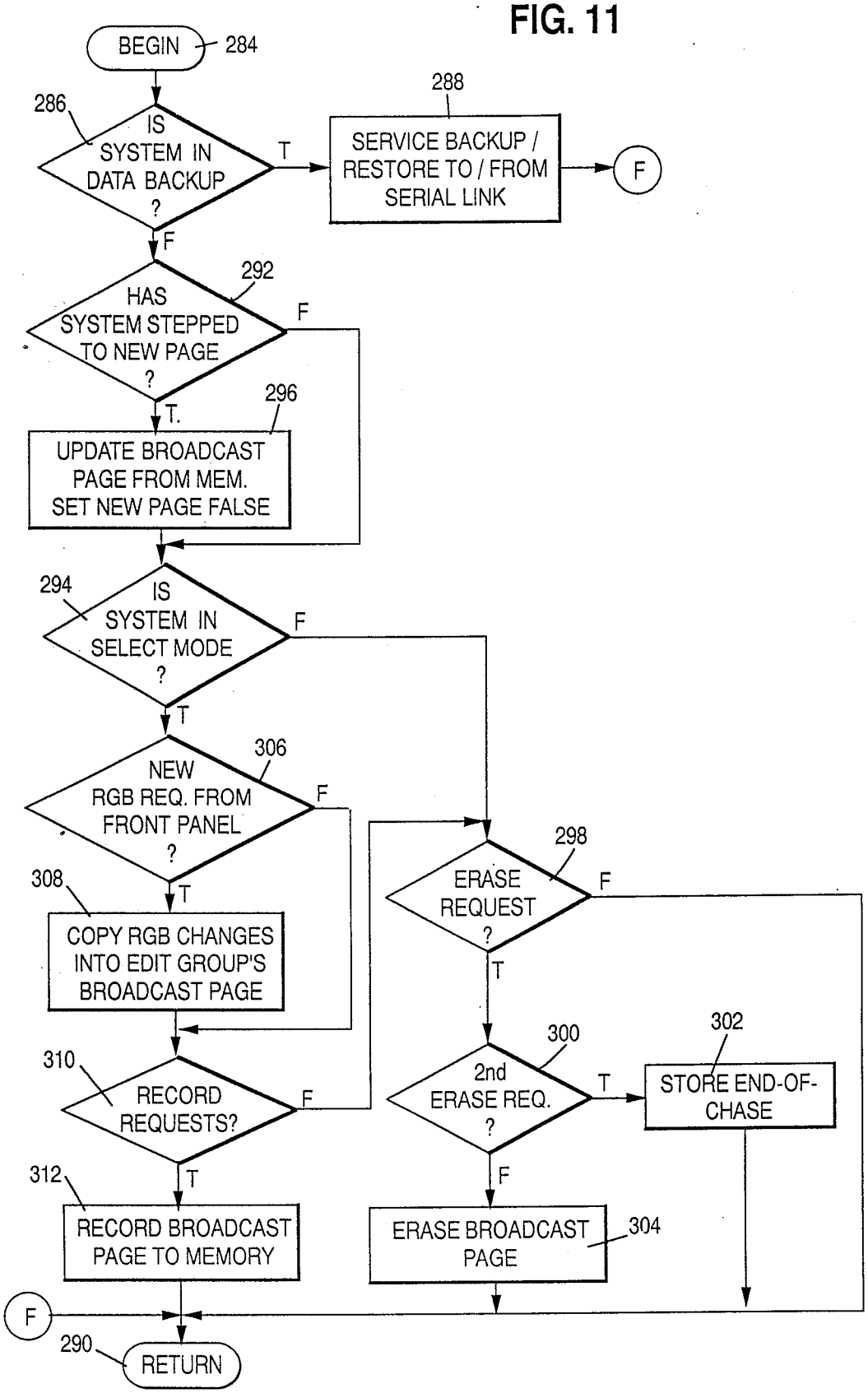
FIG. 11 is a flow diagram of the system memory up-date step for the flow diagram of FIG. 6.

After the system page number is up-dated, the central processor unit up-dates the system memory at 282. As illustrated in FIG. 11, this memory up-date begins at 284, and at 286 a check is made to determine whether the system is in a data back-up condition. If it is, then the information from outside the central processing unit is brought in from a personal computer at 288, and the system returns at 290 for the next processing step.

If the system is not in a data back-up mode, then a check is made at 292 to determine if the system has stepped to a new page. If it hasn't, then the next step is to check at 294 to determine if the system is in the "select" mode with the select switch 42 activated.

If the system has stepped to a new page as shown by the check at 292, then the memory is up-dated and a new page is transmitted from memory while the new page flag is set false at 296. At this point, the program moves on to determine whether the system is in the select mode at 294.

If the system is not in the select mode, then a check is made at 298 to determine if an "erase" request is present. If the "erase" request is not present, then the system returns for the next processing step at 290, but if the "erase" request is present, then the system checks for a second erase request at 300. If a second erase request is present, the system then stores an "end of chase" indication at 302 and moves to the process return step at 290, but if the second "erase" request is not present, then the broadcast page is erased at 304 and the program moves to the system return step 290.

If the check at 294 indicates that the system is in the "select" mode, then a check is made at 306 to determine if new color intensity data is required from the control panel 18. If such data is required, then red, green and blue intensity changes keyed into the system using the intensity control switches 34 are entered into an edited page at 308. After this is accomplished, the system moves to a "record request" step 310, but if no new intensity change requests are required at 306, the system moves directly to this step 310. If there are no requests to record into memory in step 310, then the program moves to the "erase" request section 298, but if there are requests to record, the broadcast buffer is recorded into the respective page involved which resides in memory at 312. Then the system is returned for the next program step at 290.

Figure 12:
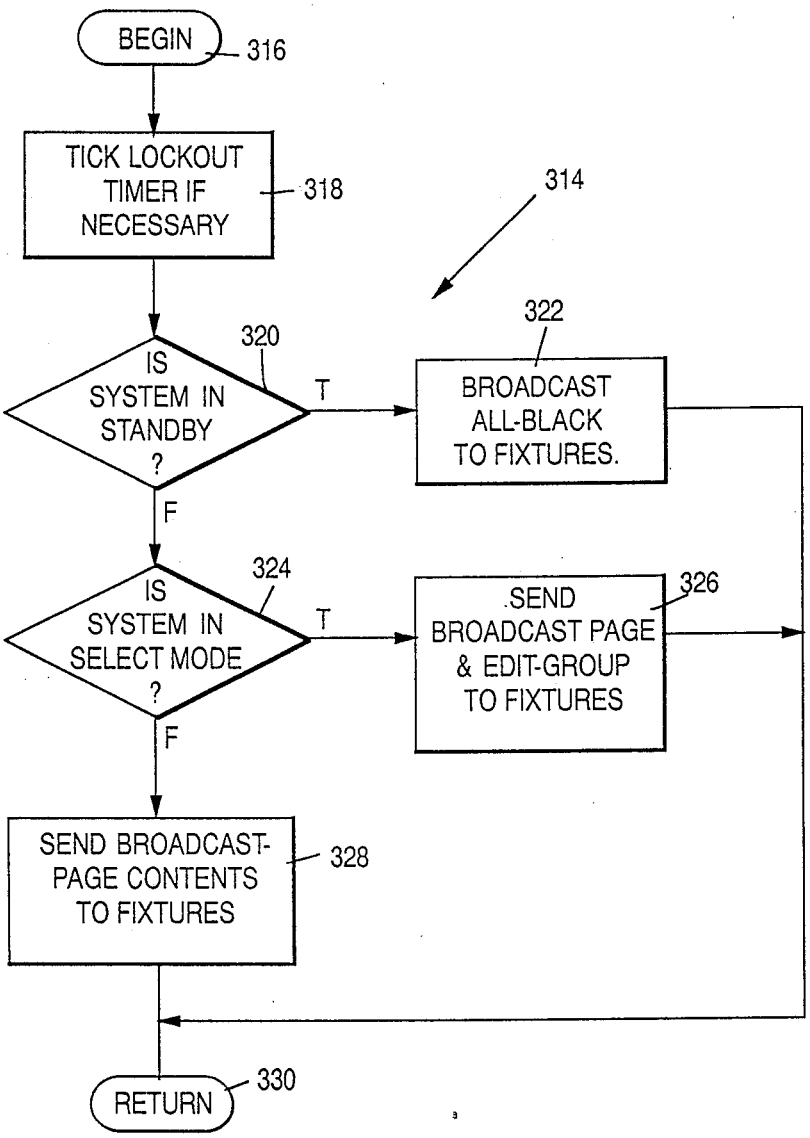
FIG. 12 is a flow diagram of the fixture link up-date step for the flow diagram of FIG. 6.

The next step in the system control loop of FIG. 6 is to up-date the fixture link at 314. This fixture link up-date is quite simple, as illustrated in FIG. 12. The process, after being begun at 316, operates to increment a lock-out timer at 318 if such is necessary. Then, at 320, it is determined whether or not the system is in stand-by. If the stand-by switch 22 is activated, then the system operates at 322 to transmit a black signal which deenergizes all light fixtures 16. On the other hand, if the system is not in stand-by, then the program determines at 324 whether or not the system is in the "select" mode with the "select" switch 42 activated. If the "select" switch has been activated, the system sends the recorded page plus any edited information to the fixture circuits at 326, but if the "select" mode has not been activated, then the system operates at 328 to send the broadcast page contents to the light fixtures. Then the system returns for the next programmed step at 330.

Returning to FIG. 6, it will be noted that after the fixture link is up-dated, the system then up-dates the front panel display 28, 30 and 32 from the various system status areas previously recorded during the programming, and finally, the system up-dates the serial link to the RS232 connection at 334. Basically, this serial link up-date determines whether or not the system is in the playback mode, and if it is, permits information to be written into the memory 72 from the RS232 input, but if the system is in the "record" mode, then contents from the memory are sent via the 232 link 92 to a personal computer.

With the central processing unit 70 in operation, the system continuously moves through the control link indicated in FIG. 6 providing any new up-dates which may be entered from the control panel 18, an external personal computer, or a master control panel. Also, the system operates during each passage through the control link to control the circuitry in the light fixtures 16 in accordance with recorded intensity information. As the system moves from one recorded page to the next within a memory, it computes the step frequencies necessary for each lamp intensity to reach the next programmed intensity within the constant number of steps programmed in the software, and each control cycle operates to increment the cross-fade timer so that each of the calculated step increments is accomplished and all three light sources fade between pages to arrive at the next program intensity simultaneously.

INDUSTRIAL APPLICABILITY

The variable color lighting system of the present invention can be used effectively for many applications, such as providing stage, theater, nightclub and studio lighting, as well as lighting for architectural purposes and special effects. Each lighting fixture contains programmable electronics to accomplish dimming and color control, and a single cable to the fixture from a central controller provides both fixture address and intensity data. No power packs or dimmers are required. One central controller will control as m any as 128 light fixtures, and additional controllers can be slaved to a master controller to provide 160 control channels which will control 1280 lighting fixtures.

What is claimed is:

1. A variable color lighting system comprising lamp means for providing variable color lighting effects in response to input control signals, each such lamp means including a plurality of light source means, each adapted to provide light of a different color, intensity control circuit means for each said light source means operative to control and vary the intensity of a light source means in response to said input control signals and address circuit means operative to permit operation of said intensity control circuit means upon receipt by said address circuit means of a predetermined address signal, and remote central controller means operative to provide said input control and predetermined address signals to said lamp means.

2. The variable color lighting system of claim 1, wherein said remote central controller means provides said input control signals to said lamp means as digital signals indicative of a desired intensity for each of said light source means.

3. The variable color lighting system of claim 2, wherein each said lamp means includes digital-to-analog conversion means operative to receive said digital signals indicative of the desired intensity for each of said light source means and to provide an analog signal indicative of a desired intensity to each of said intensity control circuit means.

4. The variable color lighting system of claim 2, wherein said central controller means is operative in response to an audio input to provide digital signals indicative of a desired intensity for each of said light source means which is a function of said audio input.

5. The variable color lighting system of claim 4, wherein each said lamp means includes at least three light source means, said central controller means operating to provide separate digital signals which are a function of the bass, mid and treble frequencies of the audio input, each of said digital signals operating to indicate a desired intensity for one of said light source means.

6. The variable color lighting system of claim 5, wherein said separate digital signals vary in response to variations in the intensity of said bass, mid and treble frequencies.

7. The variable color lighting system of claim 1, wherein said address circuit means includes manually variable address setting means operative to vary an address setting for said address circuit means to render the address circuit means operative in response to any one of a plurality of predetermined address signals.

8. The variable color lighting system of claim 1, wherein said central controller means includes a plurality of control channel means, each such control channel means being associated with a specific predetermined address signal which is distinct from the address signals associated with the remaining control channel means.

9. The variable color lighting system of claim 8, wherein said address circuit means for each said lamp means includes manually variable address setting means operative to vary an assigned address setting for said address circuit means to render the address circuit means operative in response to any one of a plurality of predetermined address signals whereby said address setting can be varied to provide an assigned address for a lamp means which corresponds with the address associated with any one of said control channel means.

10. The variable color lighting system of claim 9, wherein said central controller means includes memory means for storing programmed information, programming means operable by an operator to program intensity values for selected control channel means into said memory means to control the intensities of the light source means for lamp means having an address circuit means with an assigned address setting corresponding to the address associated with one of said selected control channel means.

11. The variable color lighting system of claim 10, wherein said central controller means includes information processor means coupled to said memory means and said programming means and operative to provide address and control signals to said lamp means in accordance with intensity values programmed into said memory means.

12. The variable color lighting system of claim 11, wherein said central controller means includes indicator means operative to display the programmed intensity values for each such control channel, said information processor means operating to cause said display means to display numerical values indicative of said programmed intensity values.

13. The variable color lighting system of claim 11, wherein said information processor means operates in a first mode to provide address and control signals to said lamp means in accordance with intensity values programmed into said memory means and in a second mode to replace said programmed intensity values in the control signals with intensity values which are a function of an audio input to said central controller means.

14. The variable color lighting system of claim 13, wherein said central controller means includes audio input means to receive said audio input, said audio input means including filter means connected to provide outputs to said information processor means which are a function of bass, mid and treble frequencies of said audio input, said information processor means operating in said second mode to provide intensity values in the control signals which are a function of the intensities of said bass, mid and treble frequencies.

15. The variable color lighting system of claim 11, wherein said programming means is operable to program sequentially into said memory means a plurality of different intensity values for each selected control channel means, said information processor means being operative to sequentially provide control signals to said lamp means in accordance with the sequence of intensity values for each selected channel means programmed into said memory means.

16. The variable color lighting system of claim 15, wherein each of the intensity values in the sequence of intensity values programmed for a selected control channel means includes a programmed intensity value for each light source means for each lamp means associated with said selected control channel means by having an address circuit means with an assigned address setting corresponding to the address associated with said selected control channel means.

17. The variable color lighting system of claim 16, wherein each programmed intensity value in the sequence of intensity values programmed for a selected control channel means represents an end intensity value for each of the light source means in each lamp means associated with said selected control channel means, said information processor means operating to provide control signals to vary the intensity of each such light source means from an initial programmed end intensity value for such light source means through a sequence of subsequent programmed end intensity values.

18. The variable color lighting system of claim 17, wherein said information processor means operates when providing control signals to vary the intensity of a light source means from one end intensity value to a subsequent end intensity value to provide intermediate changing control signals to cause said light source means to progressively vary in intensity from one end intensity value to the next end intensity value.

19. The variable color lighting system of claim 18, wherein said information processor means operates to cause all light source means in the lamp means associated with each selected control channel means to arrive at each programmed end intensity value simultaneously.

20. A variable color lighting system comprising lamp means for providing variable color lighting effects, each such lamp means including light source means adapted to provide a colored light, intensity control circuit means for each such light source means operative to control and vary the intensity of a light source means in response to an intensity control signal and central controller means operative to provide intensity control signals to said intensity control circuit means, said central controller means including a plurality of control channel means, each of said lamp means being controlled by one of said control channel means, and information processor means operative to provide intensity control signals to the intensity control circuit means for the light source means of said lamp means, said information processor means operating to progressively control the intensity of the light source means for the lamp means associated with one or more of said control channel means.

21. The variable color lighting system of claim 20, wherein said central controller means includes memory means for storing programmed information and programming means operable by an operator to program intensity values for selected control channel means into said memory means, said information processor means being coupled to said memory means and said programming means and operative to provide intensity control signals in accordance with intensity values programmed into said memory means.

22. The variable color lighting system of claim 21, wherein said central controller means includes indicator means operative to display the programmed intensity values for each such control channel, said information processor means operating to cause said display means to display numerical values indicative of said programmed intensity values.

23. The variable color lighting system of claim 21, wherein said information processor means operates in a first mode to provide address and control signals to said lamp means in accordance with intensity values programmed into said memory means and in a second mode to replace said programmed intensity values in the control signals with intensity values which are a function of an audio input to said central controller means.

24. The variable color lighting system of claim 21, wherein said programming means is operable to program sequentially into said memory means a plurality of different intensity values for selected control channel means, said information processor means being operative to sequentially provide intensity control signals in accordance with the sequence of intensity values for each selected control channel means programmed into said memory means, the control signals for a specific selected control channel means being provided to the intensity control circuit means for the light source means for lamp means associated with the specific selected control channel means.

25. The variable color lighting system of claim 24, wherein each programmed intensity value in the sequence of intensity values programmed for a selected control channel means represents an end intensity value of each of the light source means for each lamp means associated with said selected control channel means, said information processor means operating to provide control signals to vary the intensity of each such light source means from an initial programmed end intensity value for such light source means through a sequence of subsequent programmed end intensity values.

26. The variable color lighting system of claim 25, wherein said information processor means operates when providing control signals to vary the intensity of a light source means from one end intensity value to a subsequent end intensity value to provide intermediate changing control signals to cause said light source means to progressively vary in intensity from one end intensity value to the next end intensity value.

* * * * *